US005806026A

United States Patent [19]

Kim

[11] Patent Number: 5,806,026

[45] Date of Patent: Sep. 8, 1998

[54] DEGROUPING METHOD FOR AN MPEG 1 AUDIO DECODER

[75] Inventor: Hee-Su Kim, Seoul, Rep. of Korea

[73] Assignee: Samsung Electronics Co., Ltd., Kyungki-Do, Rep. of Korea

[21] Appl. No.: 757,817

[22] Filed: Nov. 27, 1996

[30] Foreign Application Priority Data

Dec. 29, 1995 [KR] Rep. of Korea ..... 1995-65742

[51] Int. Cl.[6] ..... G10L 5/00

[52] U.S. Cl. ..... 704/229; 704/500

[58] Field of Search ..... 704/201, 203, 704/500, 229

[56] References Cited

U.S. PATENT DOCUMENTS 5,649,029 7/1997 Galbi ..... 382/233

*Primary Examiner*—David R. Hudspeth
*Assistant Examiner*—Harold Zintel
*Attorney, Agent, or Firm*—Sughrue, Mion, Zinn, Macpeak & Seas, PLLC

[57] ABSTRACT

A degrouping method for an MPEG 1 decoder for degrouping three consecutive subband samples (X, Y and Z) compressed into one codeword © by a step number (N) includes the steps determining whether the value of the step number is 3, determining whether the value of the step number is 5 if the value of the step number is not 3, determining whether the value of the step number is 9 if the value of the step number is not 5, searching corresponding values of the subband samples from a first look-up table in the sequence of Z, Y and X, if the value of the step number is 3, searching corresponding values of the subband samples from a second look-up table in the sequence of Z, Y and X, if the value of the step number is 5, and searching corresponding values of the subband samples from a third look-up table in the sequence of Z, Y and X, if the value of the step number is 9, wherein the first, second and third look-up tables have the respective values of the subband samples corresponding to the codeword value. Since the MPEG 1 degrouping method obtains subband samples using look-up tables without using a divider, the number of required cycles is considerably reduced.

8 Claims, 5 Drawing Sheets

START
10
C>17 ?
Y
N
14
C>8 ?
Y
N
18
16
12
Z=0
Z=1
Z=2
OBTAIN RENEWED $C_R$ BY SUBTRACTING 9 TIMES Z FROM C
20
22
$C_R$>5?
Y
N
26
$C_R$>2?
Y
N
30
28
24
Y=0
Y=1
Y=2
OBTAIN X BY SUBTRACTING 3 TIMES Y FROM RENEWED C
32
END

START
50
C>74?
Y
N
52
C>99?
Y
N
58
C > 49?
Y
N
62
C > 24?
Y
N
66
64
60
56
54
Z=0
Z=1
Z=2
Z=3
Z=4
OBTAIN RENEWED C(CR) BY SUBTRACTING 25 TIME Z FROM C
68
70
CR > 14?
Y
N
72
CR > 19?
Y
N
78
CR > 9?
Y
N
82
CR > 4?
Y
N
86
84
80
76
74
Y=0
Y=1
Y=2
Y=3
Y=4
OBTAIN X BY SUBTRACTTING 5 TIMES Y FROM RENEWED C
88
END

DEGROUPING METHOD FOR AN MPEG 1 AUDIO DECODER

BACKGROUND OF THE INVENTION

1. Field of the Invention

The present invention relates to a moving picture experts group (MPEG) 1 decoder, and more particularly, to a degrouping method for an MPEG 1 decoder adopting a look-up table method without using a divider of the MPEG 1 decoder.

2. Description of the Prior Art

In the degrouping method for an MPEG 1 audio decoder, two divisions, which will now be described, are necessary.

During the degrouping operation, calculations are performed for extracting three sample codes from one sample code. The MPEG 1 audio decoder performs a degrouping when the number of steps are 3, 5 and 9, as indicated in the following Table 1.

TABLE 1

| No. of steps | Grouping | Samples/codeword | Bits codeword |
|---|---|---|---|
| 3 | O | 3 | 5 |
| 5 | 0 | 3 | 7 |
| 7 | x | 1 | 3 |
| 9 | 0 | 3 | 10 |
| 15 | x | 1 | 4 |
| 31 | x | 1 | 5 |
| 63 | x | 1 | 6 |
| 127 | x | 1 | 7 |
| 255 | x | 1 | 8 |
| 511 | x | 1 | 9 |
| 1023 | x | 1 | 10 |
| 2047 | x | 1 | 11 |
| 4095 | x | 1 | 12 |
| 8191 | x | 1 | 13 |
| 16383 | x | 1 | 14 |
| 32767 | x | 1 | 15 |
| 65535 | x | 1 | 16 |

From the above Table 1, O represents that grouping is performed, and X represents that grouping is not performed.

As understood from Table 1, three samples are included for each codeword where the degrouping is to be performed. However, in the other cases, one sample is included per codeword.

In order to facilitate the explanation of the degrouping method, a grouping method in an encoder, which is a reverse operation of the degrouping operation, will first be explained. Three continuous subband samples X, Y and Z, are compressed into one codeword VI, where I=3, 5 and 9, by performing a calculation as indicated in the following Table 2, according to the number of steps, to obtain the values of V3, V5 and V9.

TABLE 2

| No. of steps | Grouping | Range of V | Range of X, Y and Z |
|---|---|---|---|
| 3 | V3 = 9Z + 3Y + X | $0 \geqq V3 \geqq 26$ | X, Y, Z $\geqq$ 2 |
| 5 | V5 = 2.5Z + 5Y + X | $0 \leqq V5 \leqq 124$ | X, Y, Z $\leqq$ 4 |
| 9 | V9 = 81Z + 9Y + X | $0 \leqq V9 \leqq 728$ | X, Y, Z $\leqq$ 8 |

As indicated in the above Table 2, V3 has a maximum value of 26. Since when V3=26, X=2, Y=2 and Z=2, the values of X, Y and Z are restricted so that X, Y, and Z$\leqq$2. Similarly, restrictions X, Y, Z$\leqq$4 and X, Y, Z$\leqq$8 arise with respect to the maximum values 124 and 728 of V5 and V9, respectively.

As one degrouping method for a value grouped in the aforementioned grouping method, the remainders obtained by dividing the sample code value by the number of steps are X, Y and Z. In more detail, first, the value of the sample code is divided by the number of steps to obtain a remainder X, the quotient thereof is further divided by the number of steps to obtain a remainder Y, and the final quotient becomes Z, without further division, which is written in the following equation (1):

$$S[i]=C\%NLEVELS,\ C_R=C\ DIV\ NLEVELS \quad (1)$$

where S[i] is a subband sample, X, Y or Z, C is a sample code value, V3, V5 or V9, % is an operator for obtaining the remainder, e.g., 13%3=1, DIV is an operator for obtaining the quotient, e.g., 13 DIV 3=4, and NLEVEL is the number of steps.

For example, if the number of steps is 3,

C=V3=9Z+3Y+Z, NLEVEL=3,

S [1]=C%3=(9Z+3Y+X)%3=X (remainder), $C_R$=3Z+Y (quotient)

S [2]=C%3=(3Z+Y)%3=Y (remainder), $C_R$=Z (quotient)

S[3]=C%3=Z%3=Z (remainder) (because X, Y, Z$\leqq$2).

In other words, S[1]=X, S[2]=Y and S[3]=Z. Thus, it is understood that X, Y and Z are exactly restored.

For example, if C=17 and NLEVEL=3, X=17%3=2, $C_R$=5, Y=5%3=2, C=1, and Z=1%3=1.

However, a chip SSP1601 which executes such conventional divisions, requires 120 cycles for each division, which is a large number of cycles. Other digital signal processors besides the chip SSP1601 also require a relatively large number of cycles for each division.

SUMMARY OF THE INVENTION

Accordingly, the present invention has been made in view of the problem occurring in the prior art, and an object of the present invention is to provide a degrouping method for an MPEG 1 audio decoder for performing a degrouping adopting a look-up table using restrictions of each sample, without using a divider.

To accomplish the above object, there is provided a degrouping method for an MPEG 1 audio decoder for degrouping three consecutive subband samples(X, Y and Z) compressed in one codeword(C) by the step number(N), the method comprising the steps of: determining whether the value of the step number is 3 (first determining step); determining whether the value of the step number (N) is 5 if the value of the step number (N) is not 3 in the first determining step (second determining step); determining whether the value of the step number (N) is 9 if the value of the step number (N) is not 5 in the second is determining step (third determining step); searching corresponding values of the subband samples from a first look-up table in the sequence of Z, Y and X, if the value of the step number (N) is 3 (first sample value searching step); searching corresponding values of the subband samples from a second look-up table in the sequence of Z, Y and X, if the value of the step number (N) is 5 (second sample value searching step); and searching corresponding values of the subband samples from a third look-up table in the sequence of Z, Y and X, if the value of the step number (N) is 9 (third sample value searching step); wherein the first, second and third look-up tables have the respective values of the subband samples corresponding to the codeword (C) value.

BRIEF DESCRIPTION OF THE DRAWINGS

The above objects, other features and advantages of the present invention will become more apparent by describing in detail a preferred embodiment thereof with reference to the attached drawings, in which.

DETAILED DESCRIPTION OF THE PREFERRED EMBODIMENT

Figure 1:
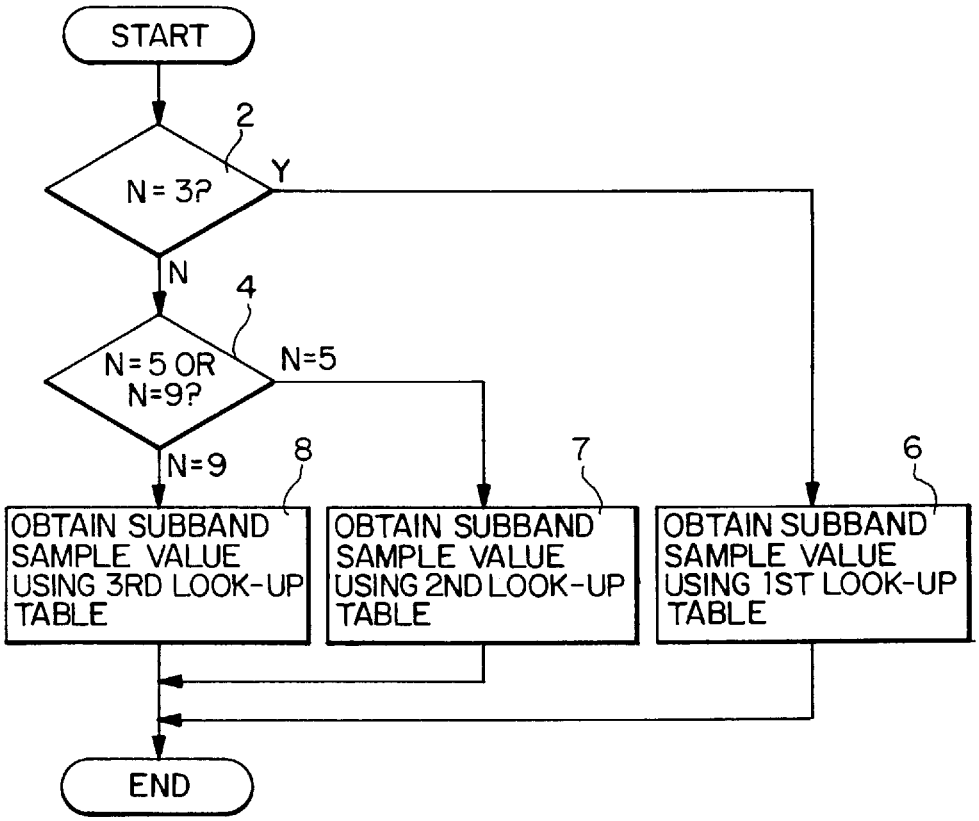
FIG. 1 is a flowchart for explaining a degrouping method according to the present invention.

Referring to FIG. 1, the degrouping method according to the present invention includes the steps of determining the number of steps (steps 2 and 4) and obtaining subband samples according to the step number (steps 6 through 8).

According to the method shown in FIG. 1, samples are obtained in the sequence of Z, Y and X, in contrast to the conventional method.

If three consecutive subband samples X, Y and Z compressed into one codeword C are to be degrouped by the step number N, it is first determined whether N is 3 (step 2). If N is not 3, it is determined whether N is 5 or 9 (step 4). If N is 3 in the step 2, the corresponding values of the subband samples are searched in the sequence of Z, Y and X from a first look-up table (step 6). However, if N is 5, the corresponding values of the subband samples are searched in the sequence of Z, Y and X from a second look-up table (step 7). If N is 9, the corresponding values of the subband samples are searched in the sequence of Z, Y and X from a third look-up table (step 8). Here, the first, second and third look-up tables have the subband sample values corresponding to the value of the codeword C, which will be described later.

Figure 2:
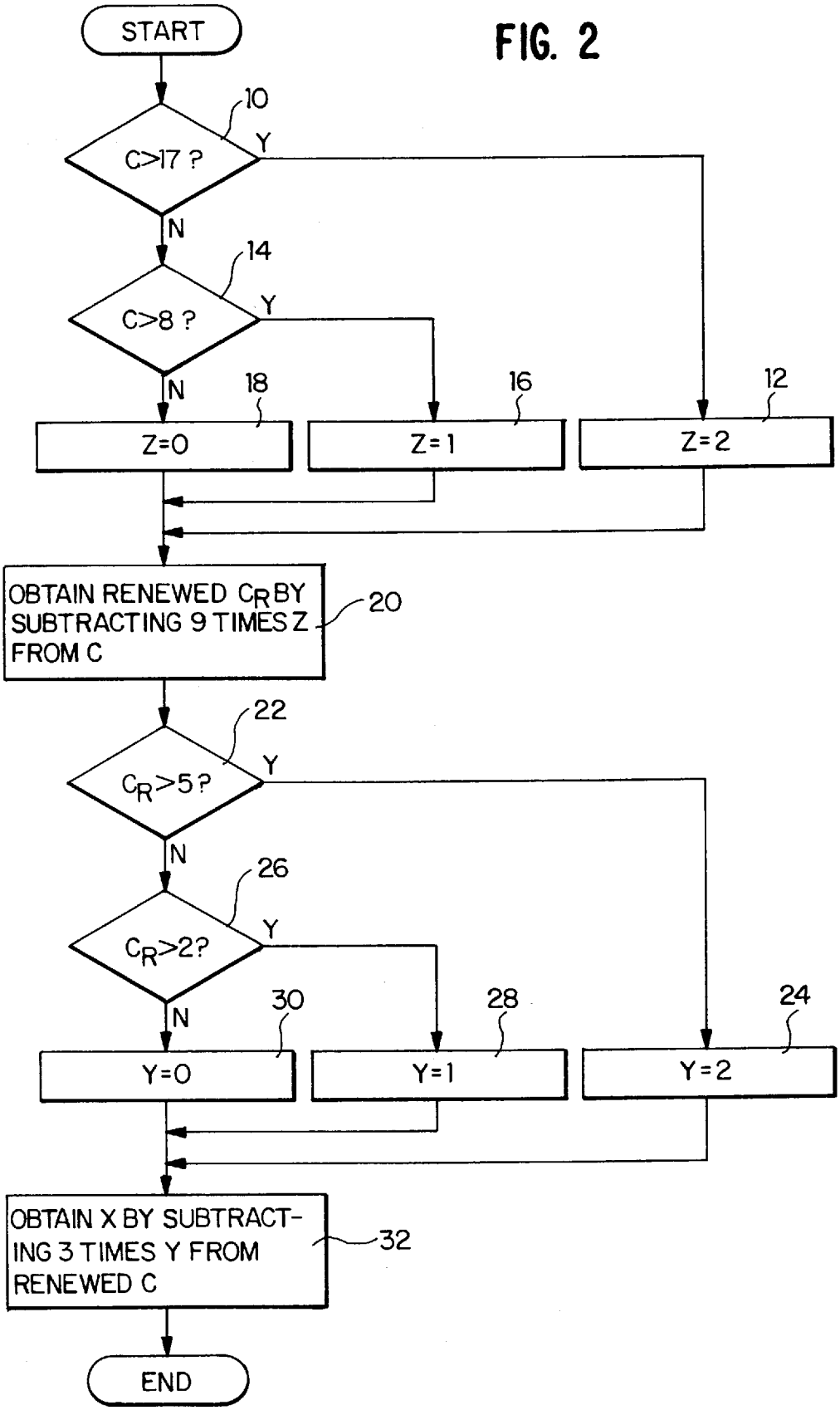
FIG. 2 is a flowchart for explaining a degrouping method according to the present invention in case of 3 steps.

FIG. 2 is a flowchart for explaining a degrouping method according to the present invention in case when N is 3, which includes the steps of determining a value of Z (steps 10 through 18), determining a value of Y (steps 20 through 30), and determining a value of X (steps 32).

Figure 3:
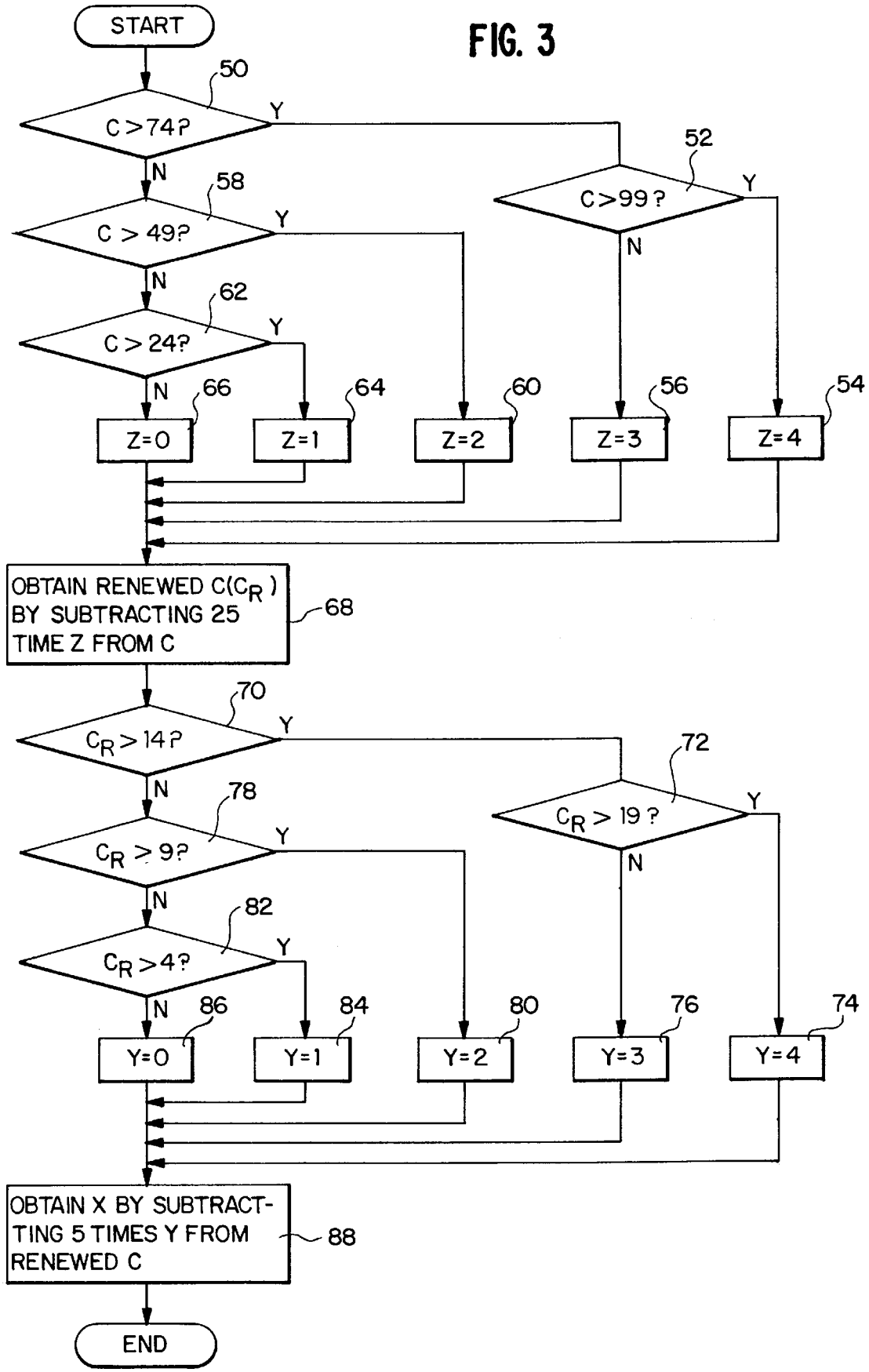
FIG. 3 is a flowchart for explaining a degrouping method according to the present invention in case of 5 steps.

FIG. 3 is a flowchart for explaining a degrouping method according to the present invention in case when N is 5, which includes the steps of determining a value of Z (steps 50 through 66), determining a value of Y (steps 68 through 86), and determining a value of X (step 88).

Figure 4A:
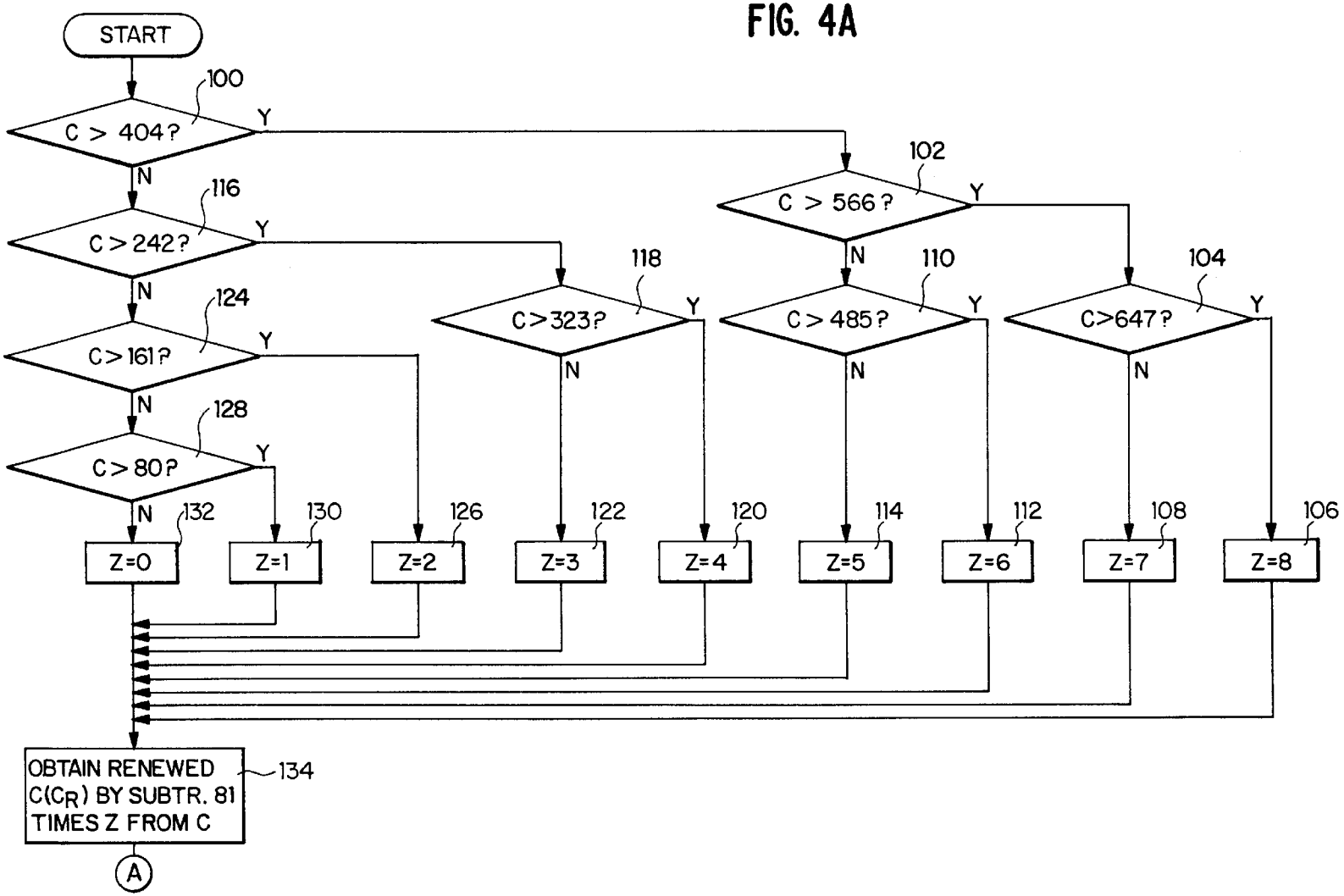
FIGS. 4A and 4B are a flowchart for explaining a degrouping method according to the present invention in case of 9 steps.
Figure 4B:
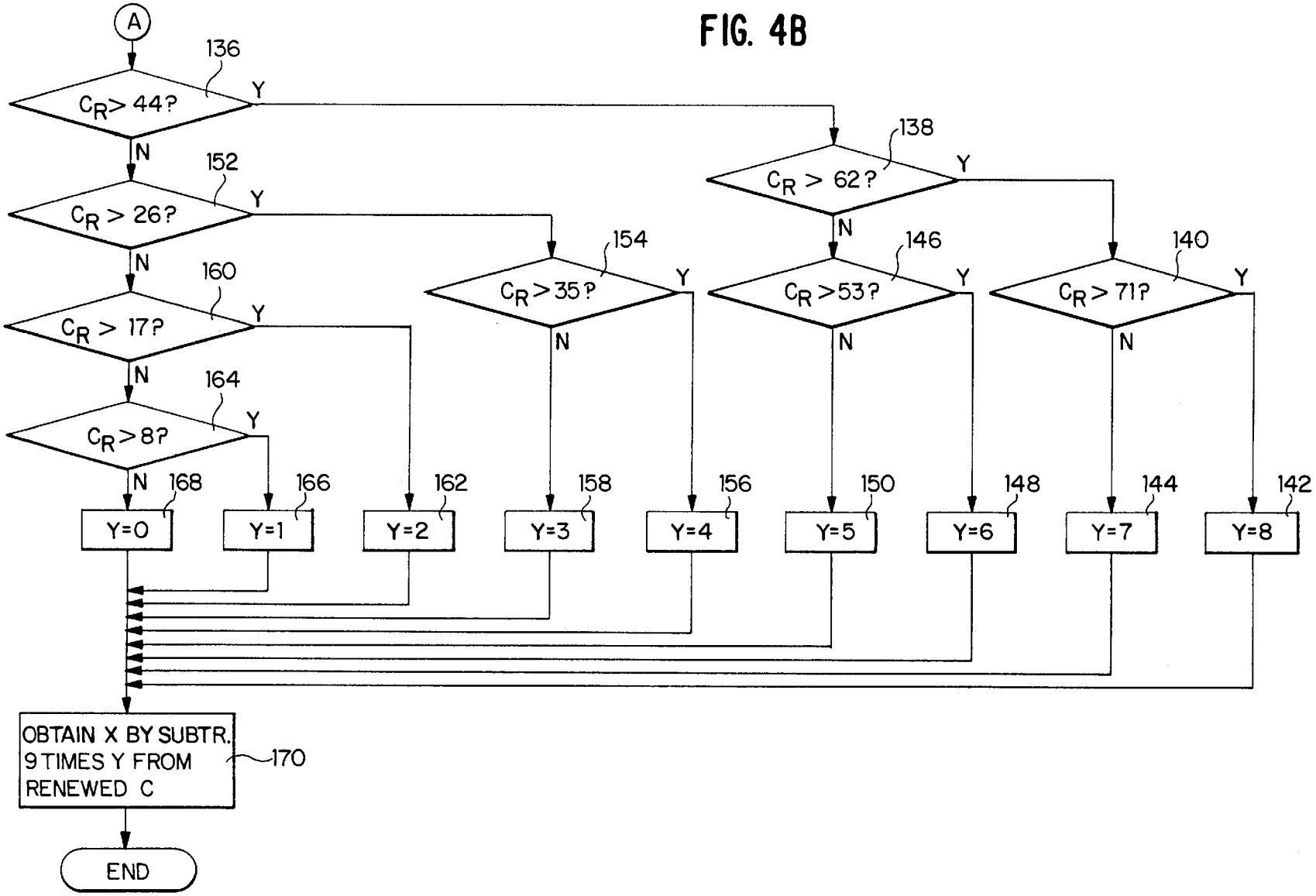

FIGS. 4A and 4B are a flowchart for explaining a degrouping method according to the present invention in a case when N is 9, which includes the steps of determining a value of Z (steps 100 through 132), determining a value of Y (steps 134 through 168), and determining a value of X (steps 170).

First, the process of determining subband samples using the first look-up table as shown in the following Tables 3A and 3B will be described, in a case when N is 3 according to the degrouping method of the present invention. Tables 3A and 3B are look-up tables for determining Z and Y, respectively.

TABLE 3A

| C | Z |
|---|---|
| 0~8 | 0 |
| 9~17 | 1 |
| 18~26 | 2 |

TABLE 3B

| $C_R$ | Y |
|---|---|
| 0~2 | 0 |
| 3~5 | 1 |
| 6~8 | 2 |

Referring to FIG. 2 and Tables 3A and 3B, first, it is determined whether the codeword C is greater than 17 (step 10). If C is greater than 17, it is determined that Z is 2 (step 12). If C is less than or equal to 17, it is determined whether C is greater than 8 (step 14). If C is greater than 8, it is determined that Z is 1 (step 16). If C is less than or equal to 8, it is determined that Z is 0 (step 18).

After determining Z, 9 times the value of Z determined in the steps 12, 16 and 18 is subtracted from the codeword C to obtain a renewed codeword $C_R$ (step 20). In other words, $C_R=C-9*Z$. After the step 20, it is determined whether the renewed codeword $C_R$ is greater than 5 (step 22). If $C_R$ is greater than 5, it is determined that Y is 2 (step 24). If $C_R$ is less than or equal to 5, it is determined whether $C_R$ is greater than 2 (step 26). If $C_R$ is greater than 2, it is determined that Y is 1 (step 28). If $C_R$ is less than or equal to 2, it is determined that Y is 0 (step 30).

After determining Y, 3 times the value of Y determined in the steps 24, 28 and 30 is subtracted from the renewed $C_R$ to obtain X (step 32). In other words, the operation of $C_R-3*Y$ is performed.

Next, the process of determining subband samples using the second look-up table as shown in the following Tables 4A and 4B will be described, in a case when N is 5 according to the degrouping method of the present invention. Tables 4A and 4B are look-up tables for determining Z and Y, respectively.

TABLE 4A

| C | Z |
|---|---|
| 0~24 | 0 |
| 25~49 | 1 |
| 50~74 | 2 |
| 75~99 | 3 |
| 100~125 | 4 |

TABLE 4B

| $C_R$ | Y |
|---|---|
| 0~4 | 0 |
| 5~9 | 1 |
| 10~14 | 2 |
| 15~19 | 3 |
| 20~24 | 4 |

Referring to FIG. 3 and Tables 4A and 4B, first, it is determined whether the codeword C is greater than 74 (step 50). If C is greater than 74, it is determined whether C is greater than 99 (step 52). If C is greater than 99, it is determined that Z is 4 (step 54). If C is less than or equal to 99, it is determined that Z is 3 (step 56). However, if C is less than or equal to 74, it is determined whether C is greater than 49 (step 58). If C is greater than 49, it is determined that Z is 2 (step 60). If C is less than or equal to 49, it is determined whether C is greater than 24 (step 62). If C is greater than 24, it is determined that Z is 1 (step 64). If C is less than or equal to 24, it is determined that Z is 0 (step 66).

After determining Z, 25 times the value of Z determined in the steps 54, 56, 60, 64, and 66 is subtracted from the codeword C to obtain a renewed codeword $C_R$ (step 68) . In other words, $C_R$=C−25*Z. After the step 68, it is determined whether the renewed codeword $C_R$ is greater than 14 (step 70). If $C_R$ is greater than 14, it is determined whether $C_R$ is greater than 19 (step 72) . If $C_R$ is greater than 19, it is determined that Y is 4 (step 74). If $C_R$ is less than or equal to 19, it is determined that Y is 3 (step 76). However, if $C_R$ is less than or equal to 14, it is determined whether $C_R$ is greater than 9 (step 78). If $C_R$ is greater than 9, it is determined that Y is 2 (step 80). If $C_R$ is less than or equal to 9, it is determined whether $C_R$ is greater than 4 (step 82). If $C_R$ is greater than 4, it is determined that Y is 1 (step 84). If $C_R$ is less than is or equal to 4, it is determined that Y is 0 (step 86).

After determining Y, 5 times the value of Y determined in the steps 74, 76, 80, 84 and 86 is subtracted from the renewed $C_R$ to obtain X (step 88). In other words, the operation of $C_R$−5*Y is performed.

Finally, the process of determining subband samples using the third look-up table as shown in the following Tables 5A and 5B will be described, in a case when N is 9 according to the degrouping method of the present invention. Tables 5A and 5B are look-up tables for determining Z and Y, respectively.

TABLE 5A

| C | Z |
|---|---|
| 0~80 | 0 |
| 81~161 | 1 |
| 162~242 | 2 |
| 243~323 | 3 |
| 324~404 | 4 |
| 405~485 | 5 |
| 486~566 | 6 |
| 567~647 | 7 |
| 648~728 | 8 |

TABLE 5B

| $C_R$ | Y |
|---|---|
| 0~8 | 0 |
| 9~17 | 1 |
| 18~26 | 2 |
| 27~35 | 3 |
| 36~44 | 4 |
| 45~53 | 5 |
| 54~62 | 6 |
| 63~71 | 7 |
| 72~80 | 8 |

Referring to FIGS. 4A and 4B and Tables 5A and 5B, first, it is determined whether the codeword C is greater than 404 (step 100). If C is greater than 404, it is determined whether C is greater than 566 (step 102). If C is greater than 102 in the step 102, it is determined whether C is greater than 647 (step 104). If C is greater than 647, it is determined that Z is 8 (step 106). If C is less than or equal to 647, it is determined that Z is 7 (step 108). However, if C is less than or equal to 566 in the step 102, it is determined whether C is greater than 485 (step 110). If C is greater than 485, it is determined that Z is 6 (step 112). If C is less than or equal to 485, it is determined that Z is 5 (step 114). If C is less than or equal to 404 in the step 100, it is determined whether C is greater than 242 (step 116). If C is greater than 242, it is determined whether C is greater than 323 (step 118). If C is greater than 323 in the step 118, it is determined that Z is 4 (step 120). If C is less than or equal to 323, it is determined that Z is 3 (step 122). If C is less than or equal to 242 in the step 116, it is determined whether C is greater than 161 (step 124). If C is greater than 161, it is determined that Z is 2 (step 126). If C is less than or equal to 161, it is determined whether C is greater than 80 (step 128). If C is greater than 80, it is determined that Z is 1 (step 130). If C is less than or equal to 80, it is determined that Z is 0 (step 132).

After determining Z, 81 times the value of Z determined in the steps 106, 108, 112, 114, 120, 122, 126, 130 and 132 is subtracted from the codeword C to obtain a renewed codeword $C_R$ (step 134). In other words, $C_R$=C−81*Z. After the step 134, it is determined whether the renewed codeword $C_R$ is greater than 44 (step 136). If $C_R$ is greater than 44, it is determined whether $C_R$ is greater than 62 (step 138). If $C_R$ is greater than 62 in the step 138, it is determined whether $C_R$ is greater than 71 (step 140). If $C_R$ is greater than 71, it is determined that Y is 8 (step 142). If $C_R$ is less than or equal to 71, it is determined that Y is 7 (step 144). If $C_R$ is less than or equal to 62 in the step 138, it is determined whether $C_R$ is greater than 53 (step 146). If $C_R$ is greater than 53, it is determined that Y is 6 (step 148) . If $C_R$ is less than or equal to 53, it is determined that Y is 5 (step 150). If $C_R$ is less than or equal to 44 in the step 136, it is determined whether $C_R$ is greater than 26 (step 152). If $C_R$ is greater than 26, it is determined whether $C_R$ is greater than 35 (step 154). If $C_R$ is greater than 35 in the step 154, it is determined that Y is 4 (step 156). If $C_R$ is less than or equal to 35, it is determined that Y is 3 (step 158). If $C_R$ is less than or equal to 26, it is determined whether $C_R$ is greater than 17 (step 160) . If $C_R$ is greater than 17, it is determined that Y is 2 (step 162). If $C_R$ is less than or equal to 17, it is determined whether $C_R$ is greater than 8 (step 164). If $C_R$ is greater than 8, it is determined that Y is 1 (step 166). If $C_R$ is less than or equal to 8, it is determined that Y is 0 (step 168).

After determining Y, 9 times the value of Y determined in the steps 142, 144, 148, 150, 156, 158, 162, 166 and 168 is subtracted from the renewed $C_R$ to obtain X (step 170). In other words, the operation of $C_R$−9*Y is performed in the step 170.

For example, in case when the step number N is 3 and the codeword C is 22, let us obtain the subband samples X, Y and Z, respectively.

Since C=22, Z is 2, as shown in Table 3A. The codeword renewed in the step 20 is 4. Also, it is understood that Y is 1 as shown in Table 3B and X is 1 in the step 32.

As described above, since the MPEG 1 degrouping method according to the present invention obtains subband samples using look-up tables without using a divider, the number of required cycles is reduced to one fifth the number of cycles required by the conventional method.

While the present invention has been described and illustrated with reference to a preferred embodiment thereof, it is to be readily understood that the present invention is not limited to the embodiment, and various changes and modifications can be made therein without departing from the spirit and scope of the invention defined in the appended claims.

What is claimed is:

1. A degrouping method for a Motion Picture Experts Group 1 (MPEG 1) audio decoder for degrouping three consecutive subband samples (X, Y and Z) compressed into one codeword (C) by a step number (N), said method comprising the steps of:

receiving a signal which contains the codeword;

performing a first determining step of determining whether the value of said step number (N) is 3;

performing a second determining step of determining whether the value of said step number (N) is 5 if the value of said step number (N) is determined not to be 3 in said first determining step;

performing a third determining step of determining whether the value of said step number is 9 if the value of said step number (N) is determined not to be 5 in said second determining step;

performing a first sample value searching step of searching corresponding values of said subband samples from a first look-up table in a sequence of Z, Y and X, if the value of said step number (N) is determined to be 3 in said first determining step;

performing a second sample value searching step of searching corresponding values of said subband samples from a second look-up table in the sequence of Z, Y and X, if the value of said step number (N) is determined to be 5 in said second determining step;

performing a third sample value searching step of searching corresponding values of said subband samples from a third look-up table in the sequence of Z, Y and X, if the value of said step number (N) is determined to be 9 in said third determining step; and generating an audio signal using said values of subband samples;

wherein said first, second and third look-up tables contain respective values of said subband samples corresponding to said codeword value.

2. A degrouping method for an MPEG 1 audio decoder as claimed in claim 1, wherein said first sample value searching step comprises the substeps of:

determining that Z is 2 if said codeword is greater than or equal to 18;

determining that Z is 1 if said codeword is greater than or equal to 9 and is less than or equal to 17;

determining that Z is 0 if said codeword is greater than or equal to 0 and is less than or equal to 8;

subtracting 9 times Z from said codeword to obtain a renewed codeword, after determining Z;

determining that Y is 2 if said renewed codeword is greater than or equal to 6 and is less than or equal to 8;

determining that Y is 1 if said renewed codeword is greater than or equal to 3 and is less than or equal to 5;

determining that Y is 0 if said renewed codeword is greater than or equal to 0 and is less than or equal to 2; and subtracting 3 times Y from said renewed codeword to obtain X, after determining Y.

3. A degrouping method for an MPEG 1 audio decoder as claimed in claim 1, wherein said second sample value searching step comprises the substeps of:

determining that Z is 4 if said codeword is greater than or equal to 100;

determining that Z is 3 if said codeword is greater than or equal to 75 and is less than or equal to 99;

determining that Z is 2 if said codeword is greater than or equal to 50 and is less than or equal to 74;

determining that Z is 1 if said codeword is greater than or equal to 25 and is less than or equal to 49;

determining that Z is 0 if said codeword is greater than or equal to 0 and is less than or equal to 24;

subtracting 25 times Z from said codeword to obtain a renewed codeword, after determining Z;

determining that Y is 4 if said renewed codeword is greater than or equal to 20;

determining that Y is 3 if said renewed codeword is greater than or equal to 15 and is less than or equal to 19;

determining that Y is 2 if said renewed codeword is greater than or equal to 10 and is less than or equal to 14;

determining that Y is 1 if said renewed codeword is greater than or equal to 5 and is less than or equal to 9;

determining that Y is 0 if said renewed codeword is greater than or equal to 0 and is less than or equal to 4; and subtracting 5 times Y from said renewed codeword to obtain X, after determining Y.

4. A degrouping method for an MPEG 1 audio decoder as claimed in claim 1, wherein said third sample value searching step comprises the substeps of:

determining that Z is 8 if said codeword is greater than or equal to 648;

determining that Z is 7 if said codeword is greater than or equal to 567 and is less than or equal to 647;

determining that Z is 6 if said codeword is greater than or equal to 486 and is less than or equal to 566;

determining that Z is 5 if said codeword is greater than or equal to 405 and is less than or equal to 485;

determining that Z is 4 if said codeword is greater than or equal to 324 and is less than or equal to 404;

determining that Z is 3 if said codeword is greater than or equal to 243 and is less than or equal to 323;

determining that Z is 2 if said codeword is greater than or equal to 162 and is less than or equal to 242;

determining that Z is 1 if said codeword is greater than or equal to 81 and is less than or equal to 161;

determining that Z is 0 if said codeword is greater than or equal to 0 and is less than or equal to 80; and subtracting 81 times Z from said codeword to obtain a renewed codeword, after determining Z;

determining that Y is 8 if said renewed codeword is greater than or equal to 72;

determining that Y is 7 if said renewed codeword is greater than or equal to 63 and is less than or equal to 71;

determining that Y is 6 if said renewed codeword is greater than or equal to 54 and is less than or equal to 62;

determining that Y is 5 if said renewed codeword is greater than or equal to 45 and is less than or equal to 53;

determining that Y is 4 if said renewed codeword is greater than or equal to 36 and is less than or equal to 44;

determining that Y is 3 if said renewed codeword is greater than or equal to 27 and is less than or equal to 35;

determining that Y is 2 if said renewed codeword is greater than or equal to 18 and is less than or equal to 26;

determining that Y is 1 if said renewed codeword is greater than or equal to 9 and is less than or equal to 17;

determining that Y is 0 if said codeword is greater than or equal to 0 and is less than or equal to 8; and subtracting 9 times Z from said renewed codeword to obtain a renewed codeword, after determining Z.

5. A degrouping method for decoding data formatted in a Motion Picture Experts Group 1 (MPEG 1) audio format, said method comprising the steps of:

providing electronic circuitry which operates as an MPEG 1 decoder;

using said electronic circuitry for degrouping three consecutive subband samples (X, Y and Z) compressed into one codeword (C) by a step number (N) by performing the following steps:

receiving a signal which contains the codeword;

performing a first determining step of determining whether the value of said step number (N) is 3;

performing a second determining step of determining whether the value of said step number (N) is 5 if the value of said step number (N) is determined not to be 3 in said first determining step;

performing a third determining step of determining whether the value of said step number is 9 if the value of said step number (N) is determined not to be 5 in said second determining step;

performing a first sample value searching step of searching corresponding values of said subband samples from a first look-up table of the decoder in a sequence of Z, Y and X, if the value of said step number (N) is determined to be 3 in said first determining step;

performing a second sample value searching step of searching corresponding values of said subband samples from a second look-up table of the decoder in the sequence of Z, Y and X, if the value of said step number (N) is determined to be 5 in said second determining step; and performing a third sample value searching step of searching corresponding values of said subband samples from a third look-up table of the decoder in the sequence of Z, Y and X, if the value of said step number (N) is determined to be 9 in said third determining step; and generating an audio signal using said values of subband samples:

wherein said first, second and third look-up tables contain respective values of said subband samples corresponding to said codeword value.

6. A degrouping method as set forth in claim 5, wherein said first sample value searching step comprises the substeps of:

determining that Z is 2 if said codeword is greater than or equal to 18;

determining that Z is 1 if said codeword is greater than or equal to 9 and is less than or equal to 17;

determining that Z is 0 if said codeword is greater than or equal to 0 and is less than or equal to 8;

subtracting 9 times Z from said codeword to obtain a renewed codeword, after determining Z;

determining that Y is 2 if said renewed codeword is greater than or equal to 6 and is less than or equal to 8;

determining that Y is 1 if said renewed codeword is greater than or equal to 3 and is less than or equal to 5;

determining that Y is 0 if said renewed codeword is greater than or equal to 0 and is less than or equal to 2; and subtracting 3 times Y from said renewed codeword to obtain X, after determining Y.

7. A degrouping as set forth in claim 5, wherein said second sample value searching step comprises the substeps of:

determining that Z is 4 if said codeword is greater than or equal to 100;

determining that Z is 3 if said codeword is greater than or equal to 75 and is less than or equal to 99;

determining that Z is 2 if said codeword is greater than or equal to 50 and is less than or equal to 74;

determining that Z is 1 if said codeword is greater than or equal to 25 and is less than or equal to 49;

determining that Z is 0 if said codeword is greater than or equal to 0 and is less than or equal to 24;

subtracting 25 times Z from said codeword to obtain a renewed codeword, after determining Z;

determining that Y is 4 if said renewed codeword is greater than or equal to 20;

determining that Y is 3 if said renewed codeword is greater than or equal to 15 and is less than or equal to 19;

determining that Y is 2 if said renewed codeword is greater than or equal to 10 and is less than or equal to 14;

determining that Y is 1 if said renewed codeword is greater than or equal to 5 and is less than or equal to 9;

determining that Y is 0 if said renewed codeword is greater than or equal to 0 and is less than or equal to 4; and subtracting 5 times Y from said renewed codeword to obtain X, after determining Y.

8. A degrouping method as set forth in claim 5, wherein said third sample value searching step comprises the substeps of:

determining that Z is 8 if said codeword is greater than or equal to 648;

determining that Z is 7 if said codeword is greater than or equal to 567 and is less than or equal to 647;

determining that Z is 6 if said codeword is greater than or equal to 486 and is less than or equal to 566;

determining that Z is 5 if said codeword is greater than or equal to 405 and is less than or equal to 485;

determining that Z is 4 if said codeword is greater than or equal to 324 and is less than or equal to 404;

determining that Z is 3 if said codeword is greater than or equal to 243 and is less than or equal to 323;

determining that Z is 2 if said codeword is greater than or equal to 162 and is less than or equal to 242;

determining that Z is 1 if said codeword is greater than or equal to 81 and is less than or equal to 161;

determining that Z is 0 if said codeword is greater than or equal to 0 and is less than or equal to 80; and subtracting 81 times Z from said codeword to obtain a renewed codeword, after determining Z;

determining that Y is 8 if said renewed codeword is greater than or equal to 72;

determining that Y is 7 if said renewed codeword is greater than or equal to 63 and is less than or equal to 71;

determining that Y is 6 if said renewed codeword is greater than or equal to 54 and is less than or equal to 62;

determining that Y is 5 if said renewed codeword is greater than or equal to 45 and is less than or equal to 53;

determining that Y is 4 if said renewed codeword is greater than or equal to 36 and is less than or equal to 44;

determining that Y is 3 if said renewed codeword is greater than or equal to 27 and is less than or equal to 35;

determining that Y is 2 if said renewed codeword is greater than or equal to 18 and is less than or equal to 26;

determining that Y is 1 if said renewed codeword is greater than or equal to 9 and is less than or equal to 17;

determining that Y is 0 if said codeword is greater than or equal to 0 and is less than or equal to 8; and subtracting 9 times Z from said renewed codeword to obtain a renewed codeword, after determining Z.

* * * * *